US007156796B2

(12) United States Patent
Makley

(10) Patent No.: US 7,156,796 B2
(45) Date of Patent: Jan. 2, 2007

(54) INK ROLLER

(75) Inventor: James A. Makley, Springboro, OH (US)

(73) Assignee: Paxar Americas, Inc., Miamisburg, OH (US)

( * ) Notice: Subject to any disclaimer, the term of this patent is extended or adjusted under 35 U.S.C. 154(b) by 485 days.

(21) Appl. No.: 10/742,403

(22) Filed: Dec. 19, 2003

(65) Prior Publication Data

US 2005/0137070 A1 Jun. 23, 2005

(51) Int. Cl.
*B25F 5/02* (2006.01)

(52) U.S. Cl. ..... 492/45; 492/47

(58) Field of Classification Search ..... 492/45, 492/47, 48, 17
See application file for complete search history.

(56) References Cited

U.S. PATENT DOCUMENTS

| | | | | |
|---|---|---|---|---|
| 2,280,125 | A * | 4/1942 | Kauffeld | 492/45 |
| 3,139,826 | A * | 7/1964 | Rainwater | 101/348 |
| 3,783,083 | A | 1/1974 | Jenkins | |
| 3,954,545 | A | 5/1976 | Hamisch, Jr. | |
| 4,207,818 | A * | 6/1980 | Hamisch, Jr. | 101/348 |
| 4,299,022 | A * | 11/1981 | Kummerl | 29/450 |
| 6,234,078 | B1 | 5/2001 | Kessler | |

* cited by examiner

*Primary Examiner*—Marc Jimenez
(74) *Attorney, Agent, or Firm*—Joseph J. Grass

(57) ABSTRACT

There is disclosed an ink roller having a base and an inked sleeve received about and in supported contact with the base, wherein the fit between the inked sleeve and the base is insufficient to prevent relative slippage or rotation between the base and the sleeve, and wherein one or more small ridges on the base engage the sleeve to help prevent such relative rotation.

10 Claims, 4 Drawing Sheets

INK ROLLER

BACKGROUND OF THE INVENTION

1. Field of the Invention

This invention relates to the art of printing and in particular to ink rollers.

2. Brief Description of the Prior Art

The following U.S. patents are made of record: U.S. Pat. Nos. 3,783,083; 3,954,545; 4,207,818; and 6,234,078.

As shown, for example, in U.S. Pat. No. 3,783,083 it is known to provide an ink roller which rolls over a print head to ink its printing characters. The ink roller typically includes a sleeve-mounting base with a circular-cylindrical outer surface. A tubular, porous, resilient, inked sleeve is received about the base and has an inner surface in supported contact in the outer surface of the base. In order to keep the sleeve from rotating or slipping relative to the base during inking of the print head, the inside diameter of the inked sleeve is made smaller than the outside diameter of the base. The sleeve is stretched over the base and consequently the sleeve is under hoop tension. Accordingly, the sleeve grips the base and rotation of the sleeve and the base relative to each other is prevented. This, however, causes the ink-containing cells of the porous sleeve to be compressed or squeezed. Cell compression is most prevalent at or near the inside surface of the sleeve and becomes progressively less as the distance from the axis of the sleeve increases. However, cell compression can occur throughout the sleeve. The effect of cell compression is to force or squeeze the ink-containing cells or pores, which forces ink out of these pores. The ink that was squeezed out migrates toward the outer surface of the sleeve. This causes overinking of the print head particularly when the ink roller is new. The printer will print indicia on a surface, such as the surface of a label, with an excessive amount of ink until such time as the excess ink is depleted. Not only does this give the printed indicia a poor appearance and can lead to smearing of the excess ink following printing but the useful or operational life of the ink roller is shortened because the compressed cells will have been depleted prematurely. This excess ink also has a tendency to be deposited on the inside of the ink roller packaging, giving an unsightly appearance, and at the same time increasing the likelihood that the user of the ink roller will get ink on his/her hands. In that ink is an expensive part of the cost of an ink roller, it is important to avoid such ink wastage. In a typical prior art ink roller the outside diameter of the base was 3.934 mm, the inside diameter of the inked sleeve was 3.173 mm, and the outside diameter of the inked sleeve was 10.914 mm and consequently substantial compression of the cells occurred.

SUMMARY OF THE INVENTION

It is a feature of the invention to provide an improved ink roller, wherein the ink flow to the surface of the sleeve is more uniform than in certain prior art ink rollers.

It is a feature of the invention to provide an improved ink roller wherein all the pores of the porous sleeve are substantially uncompressed.

It is a feature of the invention to provide an improved ink roller wherein ink is substantially uniform distributed throughout the porous sleeve.

It is a feature of the invention to provide an improved ink roller having a generally circular-cylindrical outer surface, with a tubular, circular, porous, resilient inked sleeve received about the base and having an inner surface in supported contact on the outer surface of the base, wherein compression of the cells or pores of the sleeve is substantially reduced over prior art ink rollers, and yet rotation of the sleeve and the base relative to each other is prevented.

It is a feature of the invention to provide an improved ink roller having a generally circular cylindrical outer surface, with a tubular, porous, resilient, inked sleeve received about the base and having an inner surface in supported contact on the outer surface of the base, and wherein the sleeve is not under hoop tension.

It is a feature of the invention to provide an improved ink roller having a generally circular-cylindrical outer surface, with a tubular, porous, resilient, inked sleeve, wherein there is a loose fit between the outer surface of the base and the inner surface of the sleeve which is insufficient to prevent rotation of the sleeve relative to the base, and there is at least one projection extending outwardly from the base surface to prevent rotation of the sleeve relative to the base.

It is a feature of the invention to provide an improved ink roller having a generally circular-cylindrical outer surface, with a tubular, porous, resilient, inked sleeve received about the base and having an inner surface in supported contact on the outer surface of the base, and one or more projections that amount to a small percentage of the area of the base engaging the inked sleeve to prevent rotation of the sleeve and the base relative to each other, while minimizing compression of the pores of the sleeve.

BRIEF DESCRIPTION OF THE DIAGRAMMATIC DRAWINGS

DETAILED DESCRIPTION OF THE PREFERRED EMBODIMENTS

Figures 1, 2:
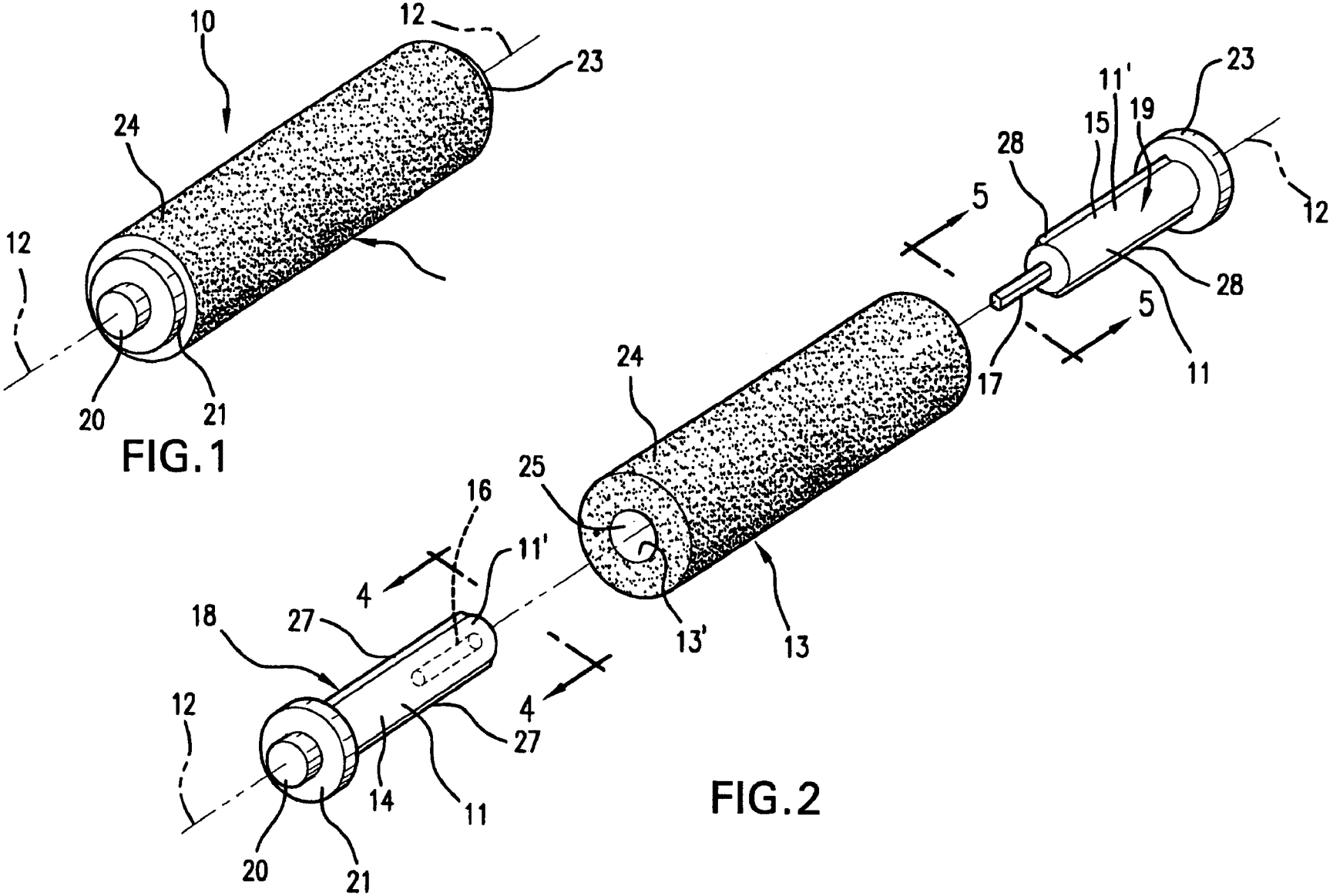
FIG. 1 is a perspective view of an assembled ink roller embodying the invention.
FIG. 2 is an exploded perspective view of the ink roller shown in FIG. 1.
Figure 3:
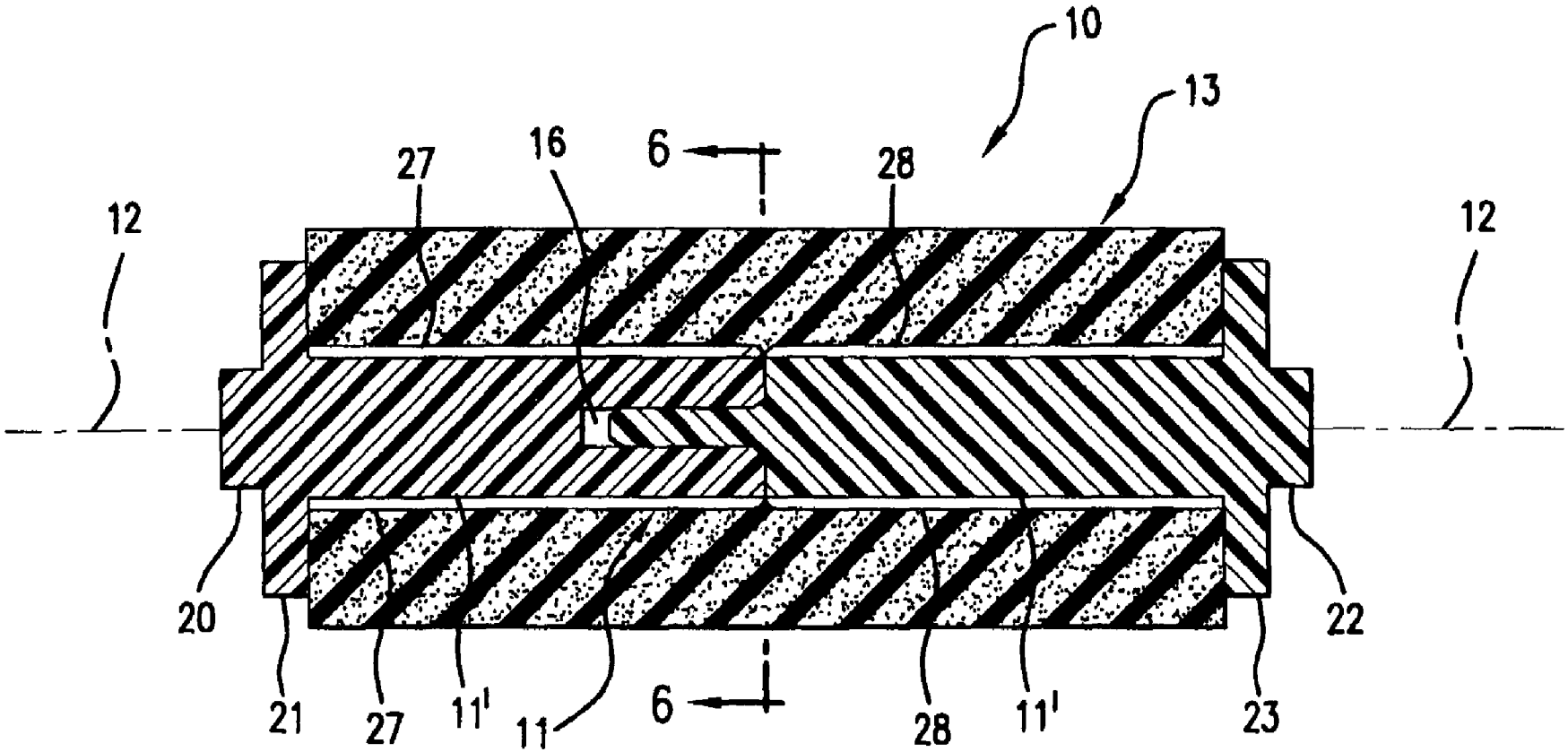
FIG. 3 is an enlarged sectional view of the assembled ink roller shown in FIG. 1.

With reference to FIGS. 1 through 3, there is shown an ink roller embodying the invention generally indicated at 10. The ink roller 10 is shown to have a base generally indicated at 11 having an axis of rotation 12. A tubular porous, resilient, inked sleeve 13 is received about the base 11. A typical sleeve material is polyurethane although other suitable materials can be used. As shown, the sleeve 13 is coaxial with the base 11 and axis 12. The base is illustrated as comprised of axially aligned base portions 14 and 15. The base portion 14 is shown to have an axial round hole 16 which receives a generally square projection 17. The corners of the projection comprise ribs or flutes that yield slightly as the projection 17 is inserted into the hole 16 to hold the assembled base portions 14 and 15 securely and non-rotatably connected to each other. The base portions 14 and 15 are shown to be parts of respective molded hub sections composed of plastics material generally indicated at 18 and 19. The hub section 18 includes a coaxial stub end or shaft 20 and a coaxial annular flange 21. The hub section 19 includes a coaxial stub end or shaft 22 and a coaxial annular flange 23. The base portions 14 and 15 are of equal length which facilitates assembly of the ink roller 10. However, the base portions need not be equal in length as in U.S. Pat. No. 6,234,078 and in fact, one base portion can be made long enough to support an entire sleeve as in U.S. Pat. No. 4,207,818.

While it is preferred to assemble the sleeve 13 onto the hub sections 18 and 19 after the sleeve 13 has been inked, an uninked sleeve can be assembled onto the hub sections 18 and 19 and the entire ink roller inked in a bath of ink under a vacuum, if desired.

The sleeve 13 is shown to have an annular or circular outer surface 24 and an axially extending bore or through-hole 25. In order to prevent compression of the cells or pores of the inked sleeve 13, the fit between the outer surface 11' of the base 11 and the inner surface 13' of the inked sleeve 13 is insufficient per se to prevent rotation of the sleeve 13 and the base 11 relative to each other. In the most preferred embodiment, the diameter of the inner or inside surface 13' of the inked sleeve 13 and the outside diameter of the base surface 11' are equal. As such, the fit between the base 11 and the inked sleeve 13 is preferably relatively loose, and, therefore, the sleeve 13 is relaxed and is not stretched. In any event the diameter of the base 11 should not be substantially greater than the inside diameter of the inked sleeve 13. Therefore, the inked sleeve 13 is not in hoop tension. This means that the cells or pores are not compressed, and accordingly ink is not squeezed from the pores. The sleeve 13 is in supported contact with the entire surface 11' of the base 11. As noted above, each base portion 14 and 15 is shown to comprise part of the base 11 in the illustrated embodiment. Each base portion 14 and 15 has a small number of respective projections 27 and 28. The projections 27 and 28 are preferably elongate in the axial direction to facilitate molding, however, projections of a wide variety of other shapes can be used. The projections 27 and 28 help prevent rotation of the sleeve 13 and the base 11 relative to each other. A lesser number of projections than illustrated can be provided so long as there is at least one projection which can prevent slippage. More projections can be used so long as the number of projections is not excessively large to compress excessive numbers of cells. The projections 27 are shown to extend for essentially the full length of the base portion 14, and the projections 28 extend for essentially the full length of the base portion 15. Combined, each pair of projections 27 and 28 extends for essentially the full length of the base 11. It should be noted that even though each pair of projections 27 and 28 is shown aligned in the drawings, when the ink roller 10 is assembled, the projections 27 and 28 will almost never be aligned, but this is unimportant because the projections 27 and 28 nevertheless perform their intended function upon engagement with the inked sleeve 13.

Figure 4:
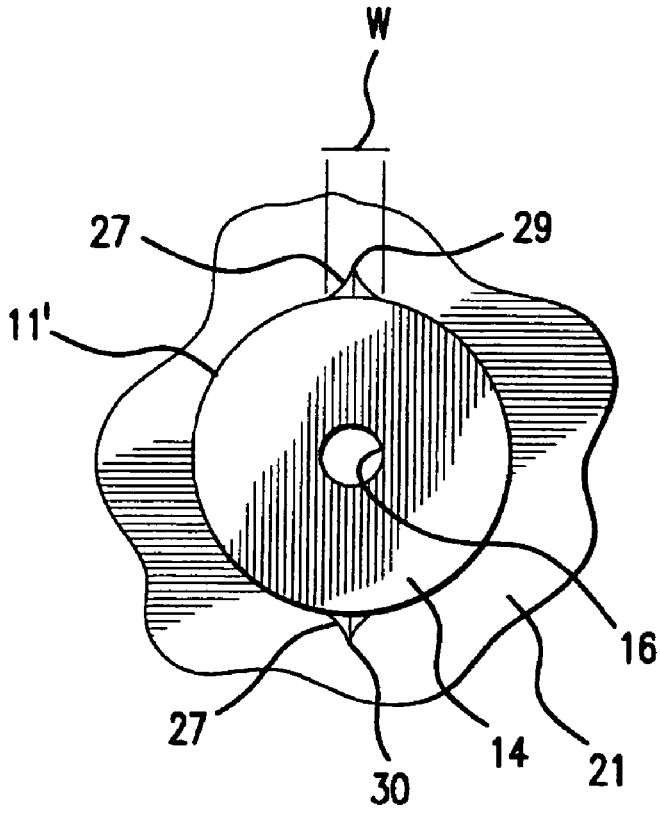
FIG. 4 is a sectional view taken along line 4—4 of FIG. 2.
Figure 5:
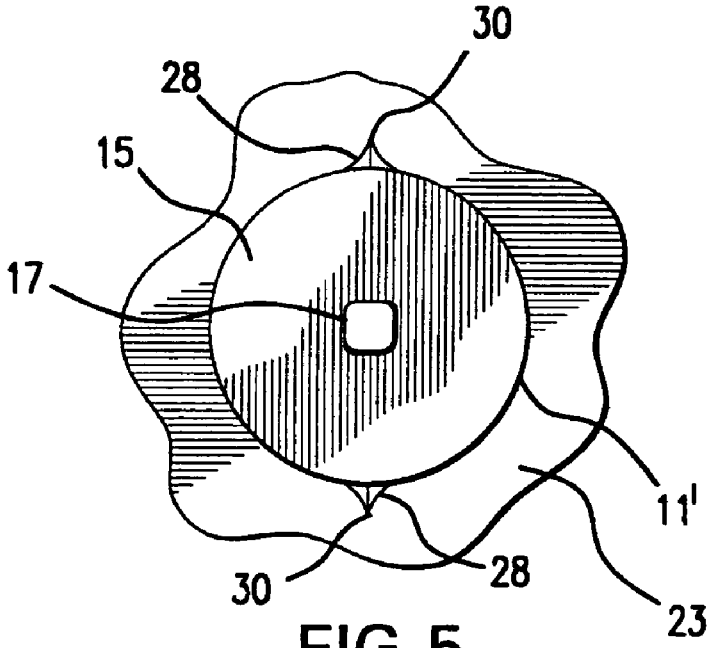
FIG. 5 is a sectional view taken along line 5—5 of FIG. 2.
Figure 6:
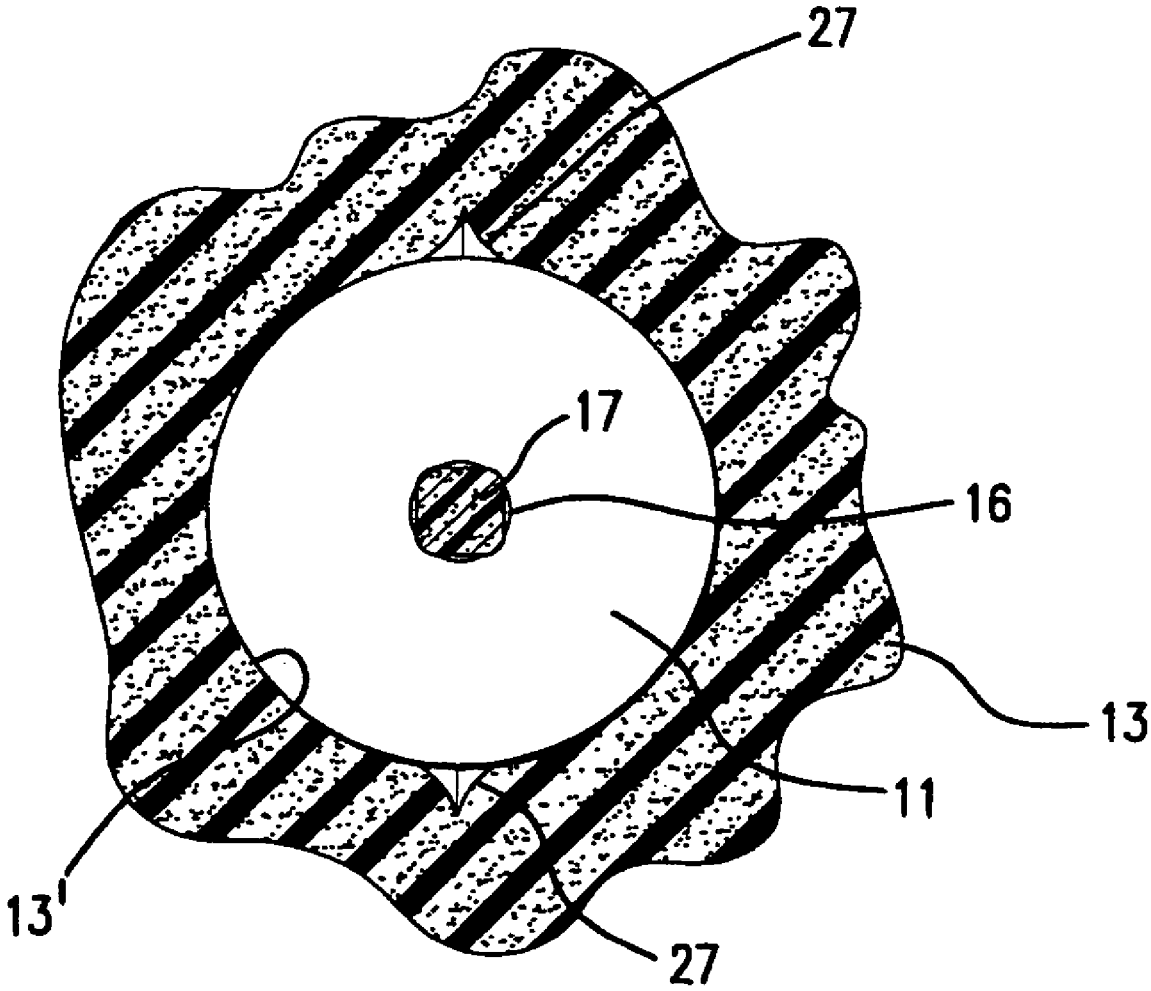
FIG. 6 is a sectional view taken generally along line 6—6 of FIG. 3.

With reference to FIGS. 4 through 6, the projections 27 and 28 are shown in greater detail. The projections 27 and 28 are molded as part of the respective hub sections 18 and 19. The projections 27 and 28 are shown to comprise generally shallow and pointed ridges or flutes, as shown, terminating in points 29 and 30, respectively. The projections 27 and 28 are shown to have a generally triangular shape which extends outwardly from the outer surfaces 11. As shown, in FIGS. 3 and 6, the projections 27 and 28 engage, or embed themselves into, the sleeve 13 to help prevent relative rotation between the base 11 and the sleeve 13 when the ink roller 10 rolls in contact with the print head. It is most preferred that the projections 27 and 28 occupy only a small percentage of the outer surface 11' of the base 11. In this way only a relatively small number of cells or pores with which the flutes 27 and 28 are engaged are compressed. Yet the projections 27 and 28 are adequate to prevent relative rotation between the base 11 of the sleeve 13. In the illustrated embodiment each pair of projections 27 and 28 occupies about 1.6 percent of the base surface 11' or the circumference of the base 11. The use of two pairs of projections 27 and 28 is more preferable than four pairs of projections 27 and 28. Four pairs would account for about 4 percent of the surface of the base. It is preferred, however that the projections 27 and 28 occupy any amount less than 20 percent of the base surface 11' or the circumference of the base 11.

By way of example, not limitation, the projections 27 and 28 are each shown to be curved or to have a hollow ground appearance. The width of the base of each of the projections 27 and 28 is about 0.2 mm as shown at W, and their height is about 0.19 mm. The included angle of each of the projections 27 and 28 with the vertex at the respective points 29 and 30 is about 60°.

By way of further example, not limitation, in one embodiment of an ink roller 10 the inside sleeve diameter of the inked sleeve 13 is about 3.173 mm, which is equal to the diameter of the outer surface 11' of base 11, and the outside diameter of the inked sleeve is 10.74 mm. While the outside diameter of the inked sleeve 13 is made 10.74 mm, it could be made 10.914 mm or some other suitable dimension, if desired. When "outer surface" of the base 11 is referred to herein, it means the surface 11' not including the projections 27 or 28.

The dimensions of the prior art sleeve referenced in the Brief Description of the Prior Art and of the sleeve 13 of the present invention are the dimensions of the respective sleeves after these sleeves have been inked. The dimensions of an uninked sleeve differ from the dimensions of an inked sleeve.

Other embodiments and modifications of the invention will suggest themselves to those skilled in the art, and all such of these as come within the spirit of this invention are included within its scope as best defined by the appended claims.

What is claimed is:

1. An ink roller assembly, comprising:

a sleeve-mounting base having a generally circular-cylindrical outer surface, a tubular, resilient sleeve having ink-containing pores received about the base and having an inner surface in relatively loosely supported contact on the outer surface of the base so that the pores are substantially uncompressed, at least one projection extending outwardly from the base surface and engaging the sleeve to prevent rotation of the sleeve relative to the base, and but for the projection(s) the sleeve and the base would be rotatable relative to each other.

2. The ink roller assembly defined in claim 1, wherein the outside diameter of the outer surface of the base and the inside diameter of the inked sleeve are substantially equal.

3. An ink roller assembly as defined in claim 1, wherein the base has an axis, and wherein the projection(s) extend(s) in the axial direction.

4. An ink roller assembly as defined in claim 1, wherein the projection(s) account(s) for about 3.2 percent of the area of the outer surface.

5. An ink roller assembly as defined in claim 1, wherein the projection(s) include(s) elongate ridge(s).

6. An ink roller assembly defined in claim 1, wherein the projection(s) is (are) molded as part of the base.

7. An ink roller assembly as defined in claim 1, wherein the sleeve is not under hoop tension.

8. An ink roller assembly, comprising:

a hub having an axis and including a pair of connected hub portions, each hub portion including a stub end for mounting the hub, a flange and a generally circular-cylindrical sleeve-mounting outer surface, wherein the stub ends extend axially and outwardly from the flanges, each hub portion having at least one elongate integrally molded projection extending outwardly from the cylindrical surface, and a tubular, resilient sleeve having ink-containing pores assembled onto the outer surfaces between the flanges, the sleeve having an inner surface in supported contact by the outer surfaces of the hub portions, wherein the inside diameter of the sleeve and the outside diameter of the surfaces are sized to provide a loose fit to prevent the pores of the sleeve from being substantially compressed, the outside diameter of the outer surfaces is not substantially greater than the inside diameter of the sleeve, and but for the projection(s) the sleeve and the hub would be rotatable relative to each other.

9. An ink roller assembly as defined in claim 8, wherein one hub portion has a second projection and the other hub portion has a projection-receiving recess for receiving the second projection.

10. An ink roller assembly as defined in claim 8, wherein the outside diameter of the outer surfaces and the inside diameter of the inked sleeve are substantially equal.

* * * * *